US007448148B2

(12) United States Patent
Martinez et al.

(10) Patent No.: US 7,448,148 B2
(45) Date of Patent: Nov. 11, 2008

(54) ARTICULATED FOLDABLE SANDALS

(75) Inventors: Benjamin Martinez, Portland, OR (US); Jeff Miller, Portland, OR (US)

(73) Assignee: Viamerica Enterprises LLC, Federal Way, WA (US)

( * ) Notice: Subject to any disclaimer, the term of this patent is extended or adjusted under 35 U.S.C. 154(b) by 400 days.

(21) Appl. No.: 11/243,271

(22) Filed: Oct. 3, 2005
(Under 37 CFR 1.47)

(65) Prior Publication Data

US 2006/0174513 A1 Aug. 10, 2006

Related U.S. Application Data

(60) Provisional application No. 60/649,989, filed on Feb. 4, 2005.

(51) Int. Cl.
*A43B 3/12* (2006.01)

(52) U.S. Cl. ..... 36/11.5; 36/102

(58) Field of Classification Search ..... 36/11.5, 36/102, 138, 13
See application file for complete search history.

(56) References Cited

U.S. PATENT DOCUMENTS 1,341,498 A * 5/1920 Demarmels et al. ..... 36/33
2,177,571 A 10/1939 Kirke
2,252,315 A 8/1941 Doree
2,466,580 A 4/1949 Dalbey
2,517,472 A 8/1950 Fathauer
2,522,515 A * 9/1950 Hill ..... 36/104
2,590,648 A * 3/1952 Pitz ..... 36/11.5
3,121,962 A 2/1964 Gullo
3,599,352 A 8/1971 Novak et al.
3,609,888 A 10/1971 Rickman
4,203,236 A 5/1980 Erikson et al.
4,348,823 A 9/1982 Knapp et al.
4,573,457 A 3/1986 Parks
5,459,950 A 10/1995 Damm et al.
5,481,814 A * 1/1996 Spencer ..... 36/138
5,784,737 A 7/1998 Tsuji
5,926,975 A 7/1999 Goodman et al.
5,956,868 A * 9/1999 Stevens et al. ..... 36/8.3
6,189,239 B1 * 2/2001 Gasparovic et al. ..... 36/102
6,298,583 B1 10/2001 Allen

* cited by examiner

*Primary Examiner*—Ted Kavanaugh
(74) *Attorney, Agent, or Firm*—Kolisch Hartwell, PC

(57) ABSTRACT

An articulated foldable sandal may include a sole having a forefoot portion that is adapted to be disposed under a front portion of a wearer's foot and a rear-foot portion that is adapted to be disposed under a rear portion of the wearer's foot. The sole may also have an articulating member that may be operatively coupled to both the forefoot portion and the rear-foot portion. The articulating member may include at least two distinct axes of rotation and may be adapted to enable the sandal to be selectively moved between an open configuration suitable for wearing and a folded configuration. The sandal may also include a retaining member fastened to the sole and adapted to hold the sandal on a wearer's foot.

30 Claims, 4 Drawing Sheets

Fig. 9
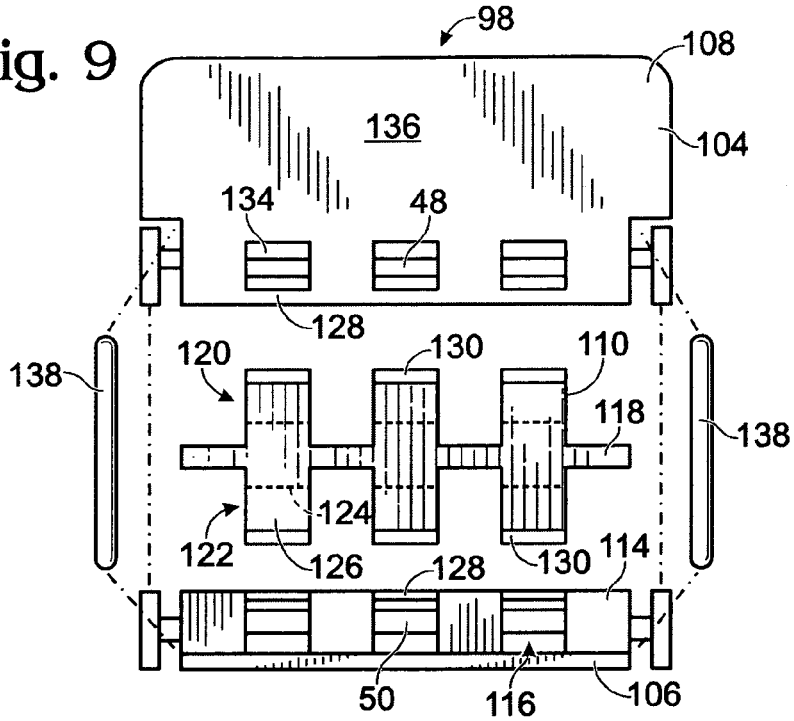
Fig. 10
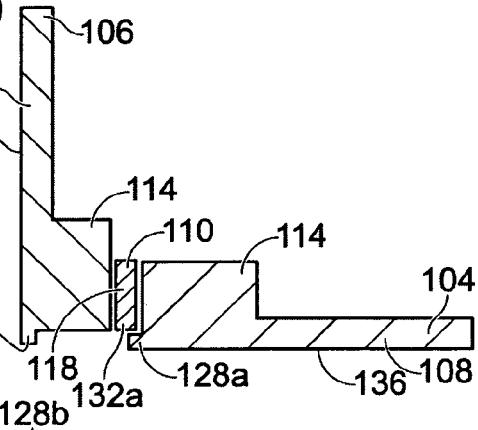
Fig. 11
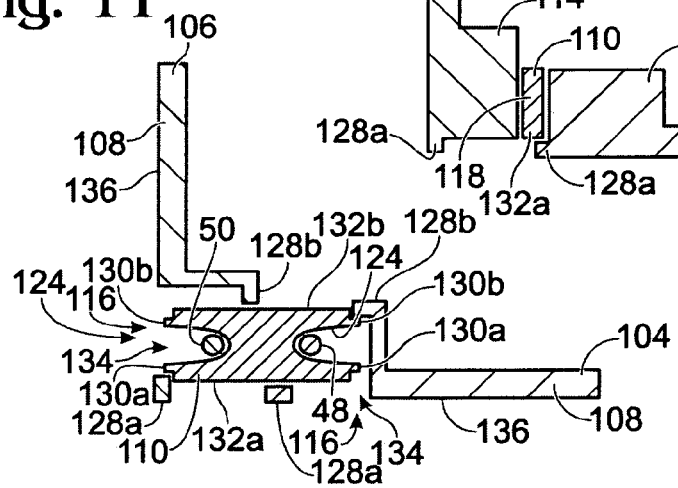
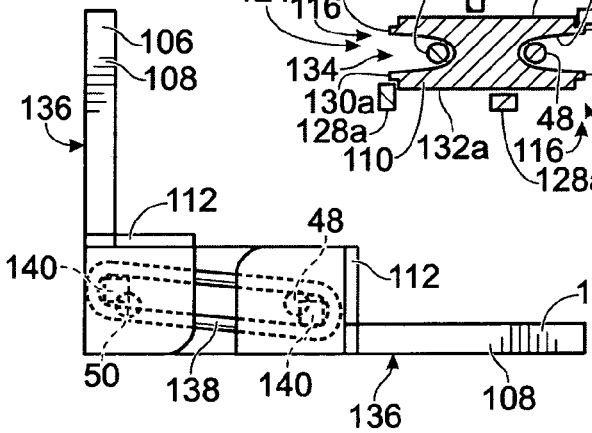
Fig. 12

ARTICULATED FOLDABLE SANDALS

CROSS-REFERENCES

This application claims the benefit of U.S. Provisional Application No. 60/649,989, filed Feb. 4, 2005. The contents of this disclosure are incorporated herein by reference in their entirety for all purposes.

TECHNICAL FIELD

The present disclosure relates generally to footwear and more particularly to articulated folding sandals.

BACKGROUND

Footwear generally serves several purposes in modern lifestyle. No longer does a person have a single pair of shoes or other footwear that is considered sufficient and appropriate for all circumstances and uses. An average person generally owns shoes adapted for a particular purpose, such as work activities, social activities, exercising, or lounging. Many people make use of more than one style of footwear in a given day. A more common example would be a person wearing a pair of shoes designed for the work environment, such as dress shoes, work boots, or other style, and at some point in the day changing the work shoes for gym shoes more conducive to whatever form of exercise is planned, such as running shoes, walking shoes, biking shoes, or the like.

Many people have a regular exercise routine away from their home, such as at their office or at a gym. In such circumstances, clothes and shoes appropriate for the exercise must be carried from the home to the office or gym on a regular basis and at times may be stored in a locker or bag at the office or gym. Additionally, people exercising away from home often prefer to shower before returning to work or other activities. Most people using common locker rooms and showers in gym facilities prefer to wear sandals in the locker room and shower rather than walking bare-footed. Sandals, in addition to their comfort and convenience, may be preferred in such circumstances because they promote hygiene by providing a barrier between the wearer and the floor. Typically, the necessary items for a person to leave work to exercise and return to work, such as exercise clothing, shoes, towels, personal hygiene products, and the like, fill or overfill the space in a bag, during transport or storage, or in a locker.

Sandals are also often worn at the beach or pool, or otherwise in connection with watersports. Sandals are worn in those circumstances to protect the user's feet from rocks, glass, or other items that may be found on the floor. The sandal provides hygienic protection during such uses as well. When a person swims as part of an exercise routine, sandals are an especially important part of the equipment both around the pool and in the locker room.

While sandals are often used in connection with locker rooms or water sports, their use is much more widespread. Many people prefer the comfort and convenience of a sandal for everyday wear or for wear around the house. Recently, designer sandals have experienced great popularity and are accepted in some circumstances as formal wear. Accordingly, sandals are often packed in bags or suitcases for overnight trips, business travel, or vacation travel. As with gym bags or lockers, space is often very limited when packing bags or suitcases for traveling.

In a typical sandal, the longitudinal direction (from toe to heel) is often several times greater than the lateral direction from the medial edge to the lateral edge. This configuration often leads to difficulty when trying to pack the sandals, particularly when trying to pack sandals into small gym bags. Many bags include pockets or pouches that are often used to separate wet items from dry items. While the width and thickness of sandals often make them easy to fit into such pouches or pockets, the length of the sandals generally makes it difficult or impossible to close the pocket or bag without exposing at least a portion of the sandals to the remaining items in the bag.

There is a continuing need for solutions to the overcrowding of bags, suitcases, and lockers. Specifically, the length/width/thickness ratio of conventional sandals makes conventional sandals difficult to pack in some circumstances. Additionally, the underside of sandals may be considered to be unsanitary or to pose increased risk of contact with dirt or bacteria from the ground, especially after being worn in public bathrooms, locker rooms, and showers. There is a continuing need for a method of packing or storing sandals that limits the exposure of the sole surface to other items being stored or packed. The present disclosure addresses these continuing needs.

SUMMARY OF THE DISCLOSURE

Some embodiments include an articulated foldable sandal including a sole that may have a forefoot portion that is adapted to be disposed under a front portion of a wearer's foot and a rear-foot portion that is adapted to be disposed under a rear portion of the wearer's foot. The sole may also have an articulating member that may be operatively coupled to both the forefoot portion and the rear-foot portion. The articulating member may include at least two distinct axes of rotation and may be adapted to enable the sandal to be selectively moved between an open configuration suitable for wearing and a folded configuration. The sandal may also include a retaining member fastened to the sole and adapted to hold the sandal on a wearer's foot.

BRIEF DESCRIPTION OF THE DRAWINGS

FIG. 9 is an exploded top plan view of the hinge assembly of the sandal of FIG. 7.

FIG. 10 is a cross-sectional view of the hinge assembly of the sandal of FIG. 7 as viewed along the plane marked 10-10 in FIG. 8.

FIG. 11 is a cross-sectional view of the hinge assembly of the sandal of FIG. 7 as viewed along the plane marked 11-11 in FIG. 8.

FIG. 12 is a top plan view of the hinge assembly of the sandal of FIG. 7.

DETAILED DESCRIPTION

Figure 1:
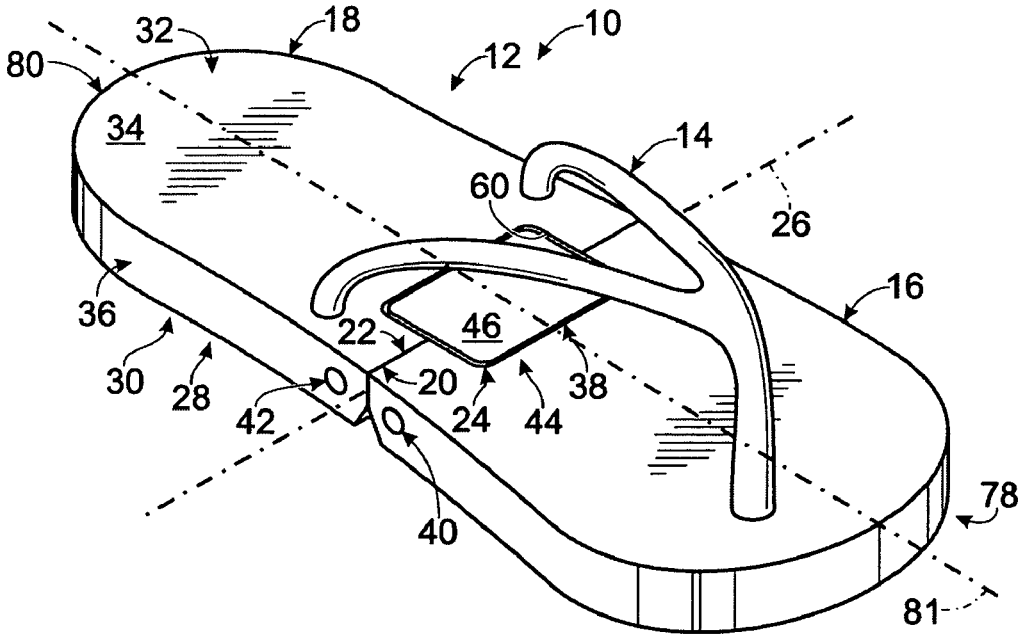
FIG. 1 is a perspective view of an articulated foldable sandal shown in an open configuration according to the present description.

An articulated foldable sandal 10 is illustrated in FIG. 1 as including a sole 12 and a retaining member 14. While the present description refers to an articulated foldable sandal, the term "sandal" should be understood herein to refer to any article of footwear having an upper adapted to allow the sole to fold according the present description. For example, the term "sandal" may refer to a traditional thong-style sandal or to a wrap-style sandal. Additionally, the term "sandal" may refer to the more contemporary variations of a sandal such as those with heel retaining members and toe retaining members, some of which also couple the heel retaining members and the toe retaining members together to form a sort of aerated or ventilated shoe. Accordingly, retaining member 14 illustrated in FIG. 1 is merely exemplary of the one or more retaining members that may operate to hold the sandal on the wearer's foot during use. Retaining member 14 may include multiple retaining members, may include straps or cords, or the like, may include panels of material between straps or cords, and may, in some embodiments, be akin to traditional shoe uppers when adapted to allow sole 12 to fold as described herein.

With reference to FIG. 1, sole 12 includes a forefoot portion 16 and a rear-foot portion 18. Forefoot portion 16 may be adapted to be disposed under the front portion of a wearer's foot during use. Forefoot portion 16 may extend rearward to a forward articulation end region 20. Rear-foot portion 18 may be adapted to be disposed under a rear portion of the wearer's foot during use. Similar to the forefoot portion, rear-foot portion 18 may extend forwardly to a rearward articulation end region 22. Forward articulation end region 20 and rearward articulation end region 22 may be disposed adjacent to each other or may be spaced from each other fully or partially by an articulating member 24. The sandal illustrated in FIG. 1 includes an articulating member 24 that partially separates forward articulation end region 20 and rearward articulation end region 22 in an interior position and is viewable from the top of sandal 10. In other configurations, the articulating member may be disposed adjacent the medial and/or lateral edges, may extend from the medial edge to the lateral edge (not shown), or may be adapted to not extend through the entire thickness of the sole.

Between forward articulation end region 20 and rearward articulation end region 22 lies a line of articulation 26. Line of articulation 26 may be formed simply by the adjacency of the forward and rearward articulation end regions 20, 22. Alternatively, when forefoot portion 16 and rear-foot portion 18 are fully spaced apart by articulating member 24, the articulating member, or a portion thereof, may define the line of articulation.

Sole 12, including forefoot portion 16 and rear-foot portion 18, may include an outsole 28 having an outsole surface 30, an insole 32 having an insole surface 34, and a midsole 36. Outsole 28, insole 32, and midsole 36 may be comprised of conventional materials used in the construction of footwear. For example, outsole 28, and specifically outsole surface 30, may include wear-resistant materials adapted to endure conditions of use over a variety of terrains. Insole 32, and specifically insole surface 34, may include materials adapted to provide a comfortable feel to the bottom of a wearer's foot. Additionally, insole 32 may include treated materials to resist bacteria, fungi, and the like. Midsole 36 may include a variety of materials, including materials to increase the wearer's comfort, retain the form of the sandal, provide a cushioned impact, or endure-various use conditions to extend the life of the sandal. Articulated foldable sandal 10 may include a sole made from traditional footwear materials or from the most contemporary footwear materials used in high-performance footwear, including waterproof materials.

In some embodiments of articulated foldable sandal 10, sole 12 may include structural features (not shown) in association with outsole 28, with insole 32, or with both the outsole and the insole. For example, outsole 28 may include traction features such as ridges and/or grooves to improve the ability of the sandal to grip the ground. The configuration of the traction features may be varied or adapted to suit a variety of applications, such as for use at the beach, at the pool, in the locker room, while river running or rafting, hiking, or during other conventional uses of sandals. Also, insole 32 may include comfort features, such as ridges, grooves, nubs, or the like to improve the comfort of the wearer and/or the ability of the wearer to keep the sandal on his/her foot. Additional features may be provided to the outsole and/or the insole to further enhance the consumer experience of wearing the sandal.

Figure 2:
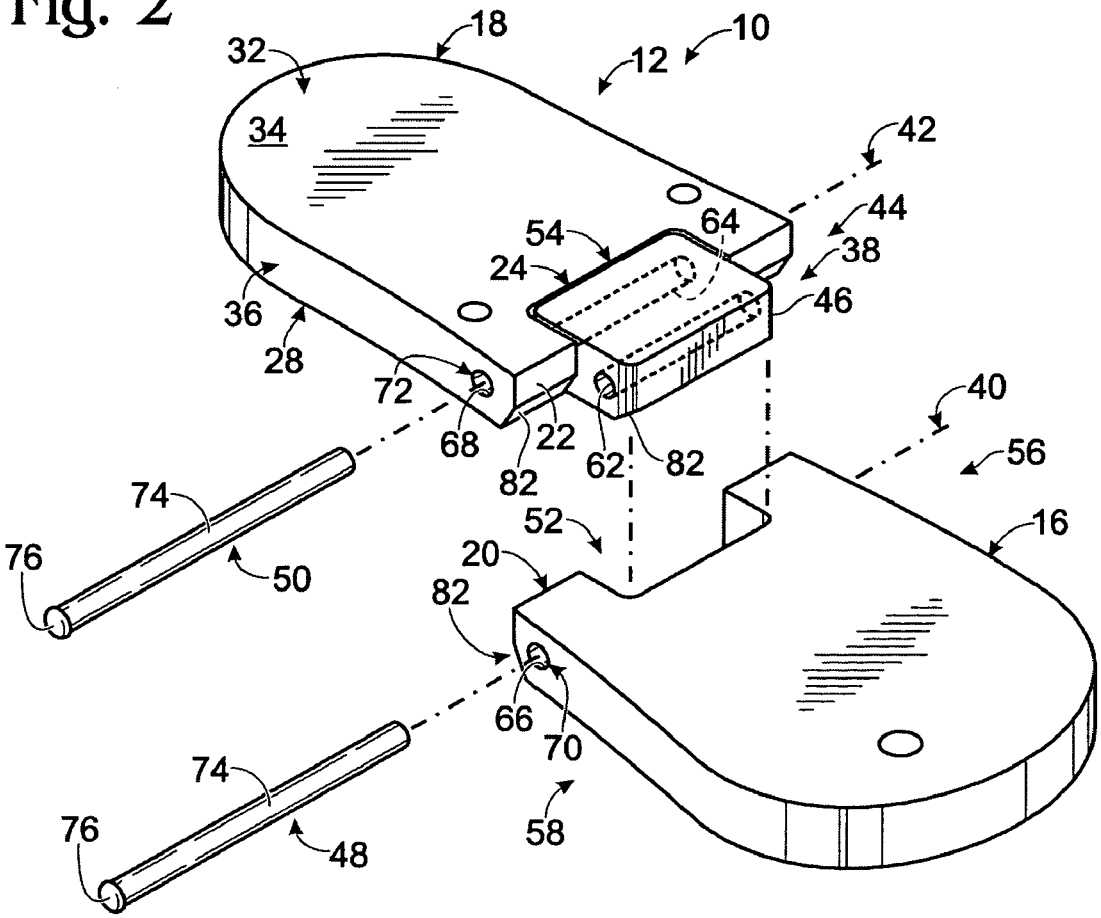
FIG. 2 is a perspective exploded view of the sandal of FIG. 1 illustrating an example of a forefoot portion and a rear-foot portion coupled by a dual-axis hinge assembly.

With reference to FIG. 2 and with continued reference to FIG. 1, forefoot portion 16 and rear-foot portion 18 may be coupled together by an articulating member 24 having at least two distinct axes of rotation. In FIG. 2, articulating member 24 is shown as a dual-axis hinge assembly 38. Dual-axis hinge assembly 38 includes a first axis 40 and a second axis 42. Dual-axis hinge assembly 38 may include additional components to operatively couple first and second axes 40, 42 to each other and to forefoot portion 16 and rear-foot portion 18, respectively. As illustrated in FIGS. 1 and 2, first and second axes 40, 42 may be disposed in a spaced-apart relationship. First and second axes 40, 42 may be maintained in a spaced-apart relationship in a number of manners. In some embodiments, the axes 40, 42 also may be disposed substantially parallel to each other.

As shown in FIGS. 1-4, dual axis hinge assembly 38 may include a block hinge assembly 44. Block hinge assembly 44 may include a block member 46, a first axle 48, and a second axle 50. Block member 46 may be sized or formed to be disposed between forefoot portion 16 and rear-foot portion 18. In some embodiments, forefoot portion 16 and rear-foot portion 18 may be provided with cutouts 52, 54, respectively, which may be at least substantially contiguous when the sandal is disposed in the open configuration, that are adapted to cooperate with block member 46. The configuration of cutouts 52, 54 may depend on the configuration of block member 46. In some embodiments, block member 46 may embody an articulating member 24, extending at least substantially from the lateral edge 56 to the medial edge 58 of sandal 10. In other embodiments, block member 46 may be narrower, as shown in FIGS. 1-4, and may be disposed within an articulation aperture 60 that is cooperatively formed by cutouts 52 and 54 and that is disposed interior to both lateral edge 56 and medial edge 58.

With continued reference to FIG. 2, block member 46 may be provided with a first block passage 62 and a second block passage 64. When block member 46 is positioned between forefoot portion 16 and rear-foot portion 18, first and second block passages 62, 64 may be adapted to align with a forefoot passage 66 and a rear-foot passage 68, respectively. When forefoot passage 66 and first block passage 62 are at least substantially aligned, the combined first passage 70 may be adapted to receive first axle 48. Similarly, when rear-foot passage 68 and second block passage 64 are at least substantially aligned, the combined second passage 72 may be adapted to receive second axle 50.

First axle 48 and second axle 50 may be rotatably disposed in the first and second passages 70, 72, respectively. In some embodiments, first and second axle 48, 50 may extend from the lateral edge 56 to medial edge 58 of sandal 10. In other embodiments, axles 48, 50 may be adapted to extend beyond the edges of block member 46 and into forefoot portion 16 and rear-foot portion 18, respectively, while not extending all the way to the medial and/or lateral edge. In these embodiments, the extension of the axles into the forefoot and rear-foot portions may assist in coupling the respective portions to the dual-axis hinge assembly.

As illustrated in FIG. 2, axles 48, 50 each include a single elongate member 74 adapted to extend beyond the edges of block member 46. Axles 48, 50 may also include additional members. For example, a cap 76 may be provided to the ends of elongate members 74. Cap 76 may provide an aesthetic value by simply covering the exposed ends of elongate members 74. Additionally, cap 76 may be adapted to help maintain axles 48, 50 in a predetermined position between the lateral and medial edges 56, 58. In some embodiments, axles 48, 50 each may include more than one elongate member. When dual-axis hinge assembly 38 includes a block hinge assembly 44, for example, first axle 48 may include a first segment extending from block member 46 to forefoot portion 16 adjacent lateral edge 56 and a second segment extending from block member 46 to forefoot portion 16 adjacent medial edge 58. As another example, first and second axles 48, 50 may include a rod and a sleeve (not shown), with the relationship between the rod and the sleeve adapted to maintain the axle, the hinge assembly, and the sole portions in the desired longitudinal and lateral relationship and to facilitate the rotation of the sole portions relative to the hinge assembly and each other. Other multi-part axles may be used and are within the scope of the present disclosure.

Figure 3:
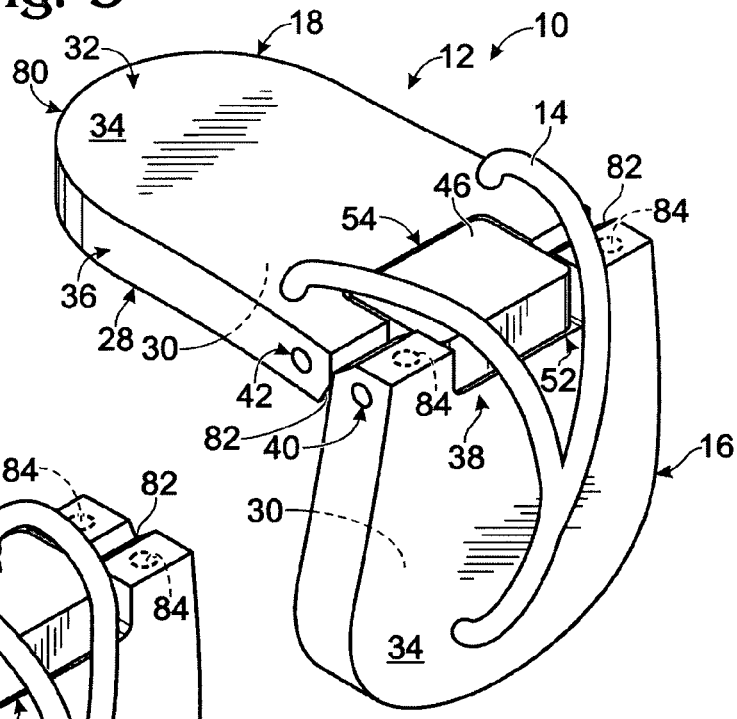
FIG. 3 is a perspective view of the sandal of FIG. 1 shown in transition between an open configuration and a folded configuration.
Figure 4:
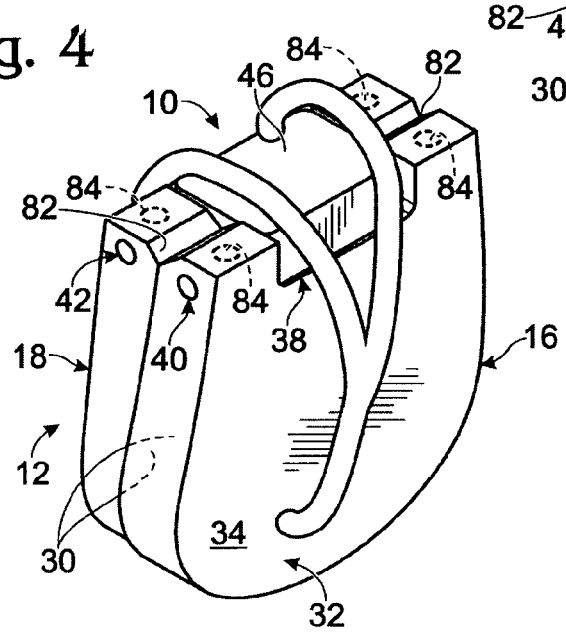
FIG. 4 is a perspective view of the sandal of FIG. 1 shown in a closed configuration according to the present description.

With reference to FIGS. 3 and 4 and with continuing reference to FIG. 1, the transition of the foldable sandals between an open configuration and a folded configuration is illustrated. FIGS. 3 and 4 continue with the illustration of the articulation member 24 as a dual-axis hinge assembly 38, and particularly a block hinge assembly 44. Articulated foldable sandal 10 is illustrated in FIG. 1 in an open configuration suitable for wearing. In the open configuration, forefoot portion 16 and rear-foot portion 18, along with block hinge assembly 44 may provide a substantially flat insole surface 34 for supporting the wearer's foot. As discussed above, insole 32 may include features or structures deviating from a flat surface, such as ridges, contours, or nubs, the relationship between forefoot portion 16, rear-foot portion 18, and dual-axis hinge assembly 38 may be adapted to provide some or all of these insole features.

As can be seen with reference to FIGS. 1, 3, and 4, the transition from the open configuration to the folded configuration is accomplished by rotating forefoot portion 16 about first axis 40 and rotating rear-foot portion 18 about second axis 42. The rotation of forefoot portion 16 and rear-foot portion 18 about their respective axes may occur in any order or simultaneously. As shown in FIGS. 3 and 4, dual-axis hinge assembly 38 and sole portions 16, 18 may be adapted to allow each sole portion to rotate substantially 90 degrees from the starting position in the open configuration to the folded configuration. While greater or lesser rotation may be possible, rotating each of the sole portions substantially 90 degrees allows the sandal to be folded compactly, reducing the longitudinal dimension of the sandal for easier packing and storing. As discussed above, in some embodiments, line of articulation 26 may be disposed substantially midway between a forward end 78 and a rearward end 80 of sole 12. In such a configuration, folding sandal 10 reduces the longitudinal dimension by about half. Moreover, line of articulation 26 may be disposed substantially perpendicular to a longitudinal axis 81 of sole 12. In such a configuration, folding sandal 10 allows for forefoot portion 16 to substantially overlap rear-foot portion when the sandal is moved to the folded configuration.

FIGS. 3 and 4 illustrate that articulated foldable sandal 10 may be configured to fold downwardly. Folding downwardly should be understood to refer to rotating the sole portions about their respective axes so that outsole surfaces 30 of forefoot portion 16 and rear-foot portion 18 are adjacent to each other, as shown in FIG. 4. Such downward folding may help to keep dirt, bacteria, fungi, or other undesirable material that may be on the outsole surfaces from contacting other items stored together with the sandals. Alternatively or additionally, sole portions 16, 18 and dual-axis hinge assembly 38 may be adapted to allow sandal 10 to fold upwardly for storage such that the insole surface of forefoot portion 16 and the insole surface of rear-foot portion 18 are adjacent to each other. Moreover, sole portions 16, 18 and block member articulation member 24 may be adapted to allow both upward and downward folding.

As illustrated in FIGS. 1-4, sole portions 16, 18 and block member 46 includes features that facilitate the downward folding of articulated foldable sandal 10. Forward articulation end region 20, rearward articulation end region 22, and each end of block member 46 may each include a bevel 82 that is adapted to ease the transition of sole 12 from the open configuration to the folded configuration, or vice versa. In FIG. 3, forefoot portion 16 is shown in a position that is rotated relative to both block member 46 and rear-foot portion 18. The presence of bevels 82 may facilitate the rotation of the forefoot portion 16 relative to the rearward articulation end region 20 and the forward end of block member 46. Similarly, bevels 82 may facilitate the rotation of the rear-foot portion 18 relative to the forward articulation end region 20 and the rearward edge of block member 46. The configuration and disposition of bevels 82 may be varied to facilitate the folding of different sandal configurations, such as different sole thicknesses or different articulation member configurations. For example, while bevels having a single angled profile are illustrated, other profiles may be implemented, such as rectangular, curved, multi-angled, or profiles of other appropriate shapes. While bevels 82 may facilitate folding, articulated foldable sandal 10 does not require bevels 82.

As the bevels facilitate folding, other portions of sandal 10 may be adapted to prevent or restrict folding. As one example, the foldable articulated sandal 10 shown in FIGS. 1-4 will not easily be moved into a folded position by folding upwardly. When upward folding is attempted, the insole of forward articulation end region 20 and the insole of rearward articulation end region 22, will strike each other and, similarly, the insole of block member 46 will strike the insole of cutouts 52, 54. Similar to the foldable articulated sandal 10 shown in FIGS. 1-4 that includes bevels 82 disposed on the outsole of forward articulation end region 20, rearward articulation end region 22, and each end of block member 46, bevels may alternatively or additionally be included on the insole regions of these elements to facilitate upward folding.

Sole 12 may include other features that either facilitate or prevent folding in either direction. Sandals 10 may be configured such that axes 40, 42 are disposed proximal to either outsole surface 30 or insole surface 34. In the case where the axes are disposed proximal to the outsole surface (not shown), downward movement of the sandal to the folded position may be easier to fold downwardly. Additionally, a sandal configured with axes 40, 42 proximal to the outsole surface may be more difficult to fold upwardly, as more of the insole portions of forefoot portion 16, rear-foot portion 18, and block member 46 may strike each other, unless bevels 82 or similar features are present.

When sole portions 16, 18 are adapted to be folded downwardly as illustrated in FIGS. 3 and 4, the cords, straps, uppers, or other materials comprising retaining members 14 may be adapted to allow for such rotation. In some embodiments, such as a wrap-style sandal where the retaining members only cover the toes and forefoot area, retaining members 14 would require little if any modification to allow downward folding. In other embodiments, including thong-style sandals shown in FIGS. 1-4 and other sandals where one or more retaining members 14 spans from forefoot portion 16 to rear-foot portion 18, retaining members 14 may include elastic segments or selectively connectable segments to allow for a proper fit during use and to allow the sandal to fold downwardly for storage. For example, in an outdoor-type sandal having heel retaining members and forefoot retaining members coupled together to form a ventilated upper, connectors or couplers may be provided to the heel retaining members and the forefoot retaining members so that they may be coupled together during use and uncoupled when the sandal is folded for storage. Suitable connectors or couplers include those devices that are traditionally used on footwear, such as buckles, snaps, hook-and-loop fasteners, and other selective coupling systems. In some embodiments, such modifications to retaining members 14 may be unnecessary. For example, retaining members 14 will have some slack between the insole and the retaining members to accommodate for the foot of the user. Depending on the configuration of sandal 10, the retaining members may already be long enough to allow for the downward folding illustrated in FIGS. 3 and 4.

With continued reference to FIGS. 3 and 4, it can be seen that articulated foldable sandal 10 may optionally include one or more locking members 84. Locking members 84 may be configured to resist unintentional transition of the sandal from the storage configuration to the open configuration, or vice versa. Exemplary locking members include mated magnets, corresponding magnets and magnetically attractive materials, telescoping rods, hook-and-loop fasteners, snaps, etc. As shown in FIGS. 3 and 4, locking members 84 include a small magnet disposed in the articulation edge regions 20, 22 of the forefoot portion 16 and rear-foot portion 18. Locking members 84 may include magnets in the opposing adjacent surfaces when sandal 10 is in the open configuration to prevent unintentional folding of the sandal during walking or other conventional use. The magnets may be strong enough to prevent unintentional rotation but weak enough to allow a user to intentionally rotate the sole portions. Additionally or alternatively, locking members, such as magnets, may be disposed on the outsole and/or insole surfaces of the sole portions to hold the sandal in the closed configuration during packing, storage, and transport.

It should be understood that locking members 84 are optional and may not be included in all embodiments of an articulated foldable sandal according to the present disclosure. For example, the configuration of the sole portions, the retaining members, and/or the dual-axis hinge assembly may include features capable of resisting unintentional rotation of the sole portions. In some embodiments, first and second axles 48, 50 and first and second passages 70, 72 may include corresponding ridges and grooves adapted to bias the sole portions in the closed and/or open configurations to prevent inadvertent rotation of the sole portions.

Figure 5:
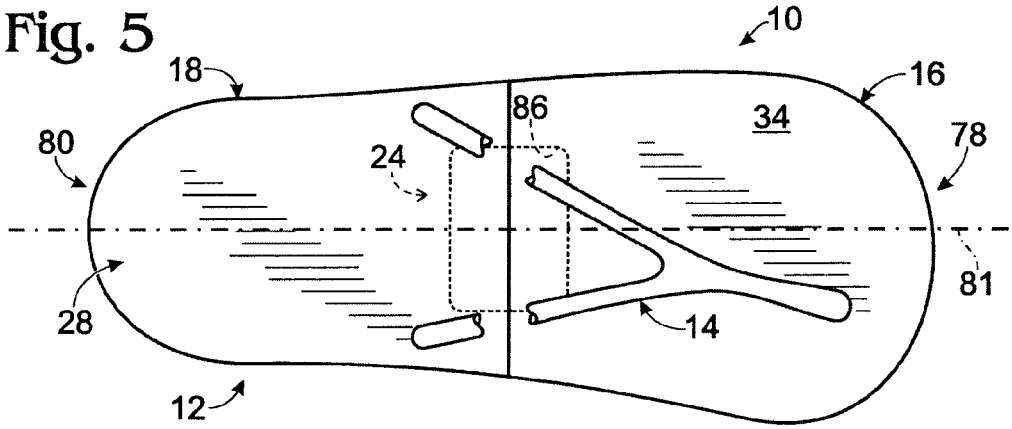
FIG. 5 is a top plan view of an articulated foldable sandal illustrating another example of a forefoot portion and a rear-foot portion having a dual axis hinge assembly that does not interrupt the insole.
Figure 6:
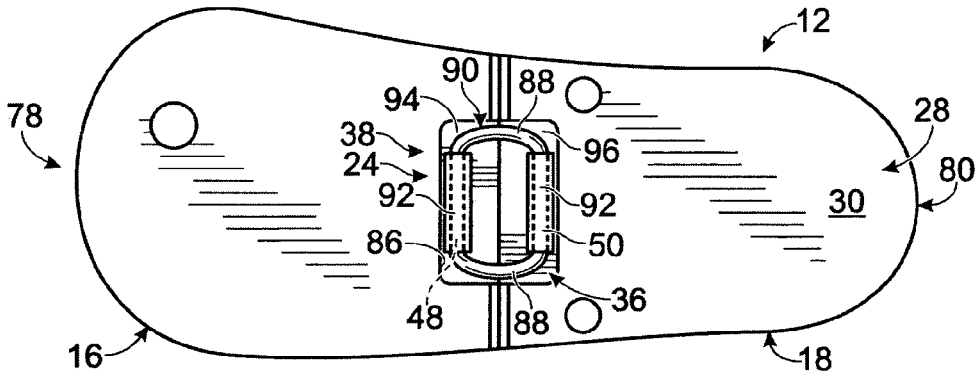
FIG. 6 is a bottom plan view of the sandal of FIG. 5 illustrating an alternative dual-axis hinge assembly according to the present description.

Articulating member 24, or, more particularly, dual-axis hinge assembly 38 may be configured in a variety of manners, including the block hinge assembly 44 illustrated in FIGS. 1-4. FIG. 5-6 illustrate an embodiment of a foldable sandal 10 according to the present disclosure that has an articulating member 24 that does not interrupt the insole surfaces 34 of the sole. Articulated foldable sandal 10 includes a sole 12 having a forefoot portion 16 and a rear-foot portion 18. In this embodiment, articulating member 24, is disposed in an articulation recess 86 formed in the outsole 28 of sole 12 to facilitate downward folding. However, articulating member 24 and articulation recess 86 may be adapted for upward folding, for downward folding, or for both.

Dual-axis hinge assembly 38 may include a first axle 48 operatively associated with forefoot portion 16 and a second axle 50 operatively associated with rear-foot portion 18. Additionally, dual-axis hinge assembly 38 may include one or more longitudinal members 88. The one or more longitudinal members 88 may extend between the first and second axles 48, 50 to couple the axles together. In some embodiments, longitudinal members 88 may couple axles 48, 50 in a fixed, spaced-apart relationship. Longitudinal members 88 may also be adapted to allow axles 48, 50 to be adjustably spaced apart between a minimum separation distance and a maximum separation distance. For example, longitudinal members 88 may provide a predetermined spacing between the axles 48, 50 when sandal 10 is in the open configuration and a different predetermined spacing when sandal 10 is in the closed configuration. Alternatively, axles 48, 50 may have the same predetermined spacing in the open and closed configurations but be required to be temporarily spaced apart to a greater or lesser degree during the transition from open to closed configuration or vice versa.

First and second axles 48, 50 may be similar to the elongate members 74 described in connection with FIGS. 1-4. In some embodiments, similar to those described above, a block member may provide the longitudinal members that longitudinally couple the first and second axles. In other embodiments, longitudinal members may be rods, telescoping rods, flexible material, or elastic material, made of plastic, fabric, metal, or other suitable materials. In some embodiments, axles 48, 50 and longitudinal members 88 may be provided by a single component. For example, as illustrated in FIG. 6, axles 48, 50 and longitudinal members 88 may be coupled together to form a connecting member 90 in the shape of an elongated toroid having two substantially parallel pairs of segments, the first pair acting as the axles 48, 50 and the second pair acting as the longitudinal members 88.

FIG. 6 also illustrates tubular members 92 of dual-axis hinge assembly 38. Tubular members 92 provide the first and second passages 70, 72 discussed above, through which axles 48, 50 pass. Additionally, tubular members 92 may be adapted to couple dual-axis hinge assembly 38 to forefoot portion 16 and rear-foot portion 18. For example, tubular members 92 may be provided with a lumen or passage therethrough, through which axles 48, 50 pass. Tubular members 92 may also include features on their exterior surface to couple the tubular members to the sole portions 16 and 18. Such features may include projections adapted to be received in sockets in the sole portions or other conventional methods of securing two components together. The tubular members may be glued or otherwise adhered to the sole portions or they may be secured by pressure and friction. In some embodiments, tubular members 92 may include a cylindrical portion and a sheet portion, or tongue. The sheet portion or tongue may be a thin material adapted to be sandwiched between the insole and the outsole, in or adjacent to the midsole material. The sheet portion or tongue may provide an anchor to retain the tubular member 92 in the desired position and may be glued or otherwise adhered to the sole.

Although one embodiment of tubular members 92 is illustrated in FIG. 6, tubular members 92 may be provided in a number of manners. As used herein, the term "tubular member" may refer to components having an outer elongate cylinder and a hollow center passage. However, "tubular member" may also refer to components of other shapes and configurations that provide a passage through which axles 48, 50 may pass. Accordingly, the term "tubular member" should be understood to refer to components of the dual-axis hinge assembly that include structures adapted to receive the axles and to act as a pivot point in the hinge assembly. Tubular members 92 may include structures or component parts made of plastics, fabrics, woven materials, non-woven materials, metals, composites, polymers, or other suitable materials and a single tubular member 92 may include structures or parts made of different materials. Axles 48, 50 may pass through the cylindrical portion of tubular members 92 and be coupled together to form the dual-axis hinge assembly 38. Alternatively, the elongate cylinder of the tubular member may be replaced by an elongate channel having an opening large enough to allow the axles to be pushed into place but small enough to retain the axles under normal usage conditions.

In embodiments of dual-axis hinge assembly including tubular members 92, axles 48, 50 need not extend entirely through the tubular members. For example, a first U-shaped member may be disposed adjacent the lateral edge of the sandal and a second U-shaped member may be disposed adjacent the medial edge. The legs of the U-shaped member may extend at least partway into the passages of the tubular members forming the axles while the bottom of the u-shaped member may form the longitudinal member coupling the axles together.

As illustrated in FIG. 6, partial cutouts, or recesses, 94, 96 may be provided to forefoot portion 16 and rear-foot portion 18, respectively, and are configured to be at least substantially aligned to form articulation recess 86. However, recesses 94, 96 only extend from the outsole into the midsole of the sandal sole portions as compared to cutouts 52, 54 of FIGS. 1-4 that extend from the outsole surface to the insole surface. The articulation recess 86 of FIG. 6 may provide a more uniform insole surface. Recesses 94, 96 may be used with any of the hinge assemblies within the scope of this disclosure.

In one example of a dual-axis hinge assembly according to the present disclosure, recesses 94, 96 are formed in the outsole and a portion of the midsole of forefoot portion 16 and rear-foot portion 18. The material removed from the recesses is preserved in substantially the original condition for subsequent use. Forefoot portion 16 and rear-foot portion 18 are placed adjacent to each other to form sole 12. A connecting member 90 is placed into the articulation recess 86, providing axles 48, 50 and longitudinal members 88. The material from the recesses is then formed to a desired configuration to accommodate the connecting member and is placed back into recesses 94, 96 to provide tubular members 92 to be secured to the sole portions. The re-use of the recess material is not necessary and any other material may be used to provide the tubular members that rotatably couple the axles to the sole portions. Similarly, the single component connecting member may be replaced with multiple components forming the axles and longitudinal members, as described above.

While the discussion of FIG. 6 described the tubular members as being secured to the sole portions and the axles being rotatably disposed in the tubular members, the dual-axis hinge assemblies of the present invention may include axles that are stationary and tubular members, or passages, that rotate relative to the sole portions. One example of this alternative configuration is the block assembly of FIGS. 1-4 where the block member rotates relative to the sole portions. It is also possible that both the axles and the tubular members are capable of rotational movement relative to the sole portions. Dual-axis hinge assemblies of the present disclosure include a first and a second axle rotatably coupled to the forefoot portion and the rear-foot portion, respectively. The first and second axles may be maintained in fixed longitudinal and lateral positions relative to the forefoot and rear-foot portions, respectively.

Figure 7:
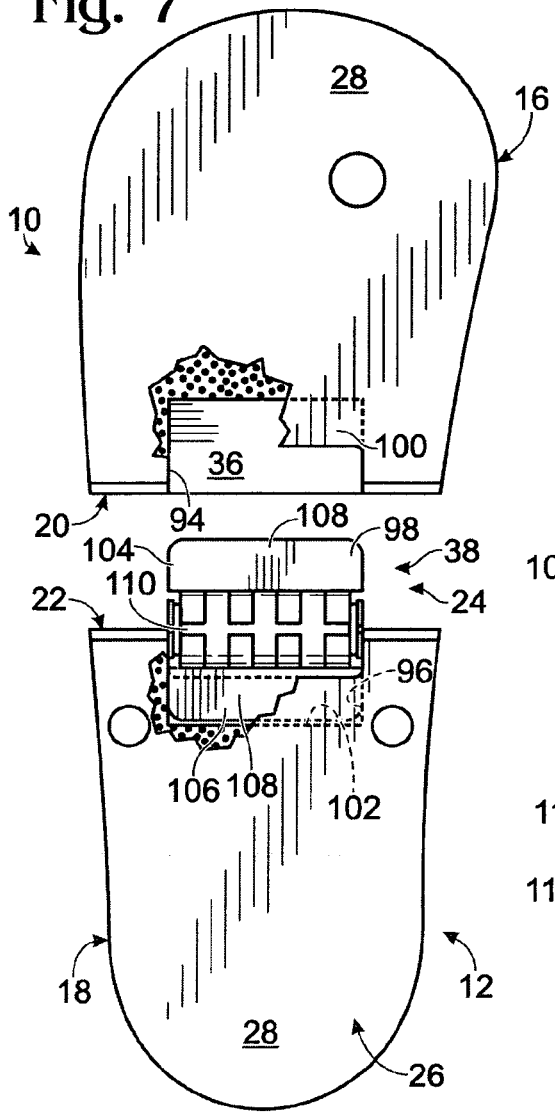
FIG. 7 is an exploded bottom plan view of an articulated foldable sandal illustrating an interdigitated hinge assembly.
Figure 8:
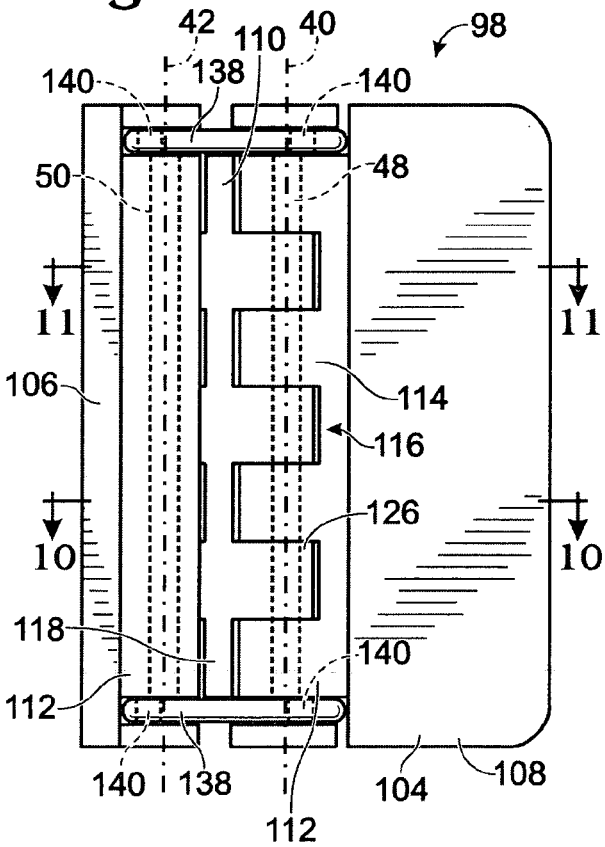
FIG. 8 is a bottom plan view of the hinge assembly of the sandal of FIG. 7.

FIG. 7 illustrates an articulated foldable sandal having the top appearance of the sandal of FIG. 5 and including an articulating member 24 provided by an interdigitated hinge assembly 98. Interdigitated hinge assembly 98 separates end regions 20, 22 at an outsole position while not extending through the entire midsole to the insole surface. Like the embodiments previously discussed, articulated foldable sandal 10 includes a sole 12 having a forefoot portion 16 and a rear-foot portion 18 that are operatively coupled by interdigitated hinge assembly 98. Similar to the sandal of FIG. 6, forefoot portion 16 and rear-foot portion 18 of the sandal 10 of FIG. 7 may include partial cutouts, or recesses, 94 and 96 that extend only from the outsole into the midsole of the sandal portions, and that may be at least substantially aligned to form an articulation recess 86. Recess 94 may include a forefoot cavity 100 that extends forward from the recess within the midsole material of the forefoot portion 16. Similarly, recess 96 may include a rear-foot cavity 102 that extends rearward from the recess within the midsole material of the rear-foot portion 16.

With reference to FIGS. 8-12, and continued reference to FIG. 7, interdigitated hinge assembly 98 may include a forefoot hinge member 104 and a rear-foot hinge member 106. Forefoot hinge member 104 may include a tongue 108 that is adapted to be inserted into forefoot cavity 100 to couple forefoot portion 16 to interdigitated hinge assembly 98. Similarly, rear-foot hinge member 106 may include a tongue 108 that is adapted to be inserted into rear-foot cavity 102 to couple rear-foot portion 18 to interdigitated hinge assembly 98. Tongues 108 may be press-fit into cavities 100 and 102 to operatively couple interdigitated hinge assembly 98 with sole 12, or more specifically, to operatively couple forefoot hinge member 104 with forefoot portion 16 and to operatively couple rear-foot hinge member 106 with rear-foot portion 18.

Hinge assembly 98 may also include an intermediate member 110 that is disposed between forefoot hinge member 104 and rear-foot hinge member 106. Forefoot hinge member 104 and rear-foot hinge member 106 may each be operatively coupled to intermediate member 110 to form first and second axes 40, 42 of dual axis hinge assembly 32.

Interdigitated hinge assembly 98 may include one or more extensions and one or more spaces disposed on the rear-foot member, the forefoot member 104, and/or the intermediate member 110. The corresponding extensions and spaces may interdigitate when the components are brought together. As illustrated, the forefoot member and rear-foot member each include four extensions and three spaces that correspond to the three extensions and four spaces of the intermediate member. Greater or fewer extensions and spaces may be provided. For example, intermediate member 110 may include a single central extension and spaces disposed on either side of the extension. Correspondingly, the forefoot member and the rear-foot member may include a central space flanked by extensions.

As illustrated, forefoot member 104 and rear-foot member 106 include body portions 112 having a plurality of block segments 114 and spaces 116. FIGS. 9-11 show axles 48 and 50 formed integrally with body portions 112 of hinge members 104 and 106. Axles 48, 50 may be formed by a single element or may be formed by a plurality of axles spanning spaces 116. In other embodiments, axles 48 and 50 may be discrete elements, as described above in reference to a block hinge assembly.

Intermediate member 110 may include a central support 118 having a first passage 120 and a second passage 122 disposed on each side. Passages 120 and 122 may be formed by a plurality of U-shaped grooves 124 that are formed within a plurality of extensions 126 that are formed on each side of central support 118. As shown in FIGS. 9-11, each extension 126 is configured to fit within a corresponding space 116 and between a pair of corresponding block segments 114 such that grooves 124 engage axles 48, 50 to enable rotation of forefoot member 104 and rear-foot member 106 relative to intermediate member 110.

Forefoot hinge member 104 and rear-foot hinge member 106 and intermediate member 110 may include elements or components that limit the amount of rotation of either the forefoot or rear-foot member relative to the intermediate member. Hinge members 104 and 106 may include one or more stop bars 128 that are configured to prevent rotation beyond a predetermined orientation. Stop bars 128 may function in conjunction with one or more surfaces 132 of intermediate member 110 in a central position, a peripheral position, or both. The central position generally corresponds to the position of central member 118, or to a position along extensions 126 that is proximal to central member 118. The peripheral position of intermediate member 110 may include one or more tabs 130 that are disposed distal to central member 118 along extensions 126.

As illustrated in FIGS. 10-11, stop bar 128*a* is configured to prevent over-rotation of either forefoot hinge member 104 or rear-foot hinge member 106 relative to intermediate member 110 when an articulated foldable sandal 10 including interdigitated hinge assembly 98 is moved to the open position. FIG. 10 shows that when the forefoot hinge member is rotated to a predetermined position relative to the intermediate member, stop bar 128*a* contacts an insole surface 132*a* of intermediate member 110 at a central position, thereby limiting the rotation. Similarly, FIG. 11 shows that stop bar 128*b* is configured to prevent over-rotation of rear-foot hinge member 106 relative to intermediate member 110 when an articulated foldable sandal 10 including interdigitated hinge assembly 98 is moved to the folded position. When the rear-foot hinge member is rotated to a predetermined orientation relative to the intermediate member, stop bar 128*b* contacts an outsole surface 132*b* of intermediate member 110 at a central position, thereby limiting the rotation.

Also illustrated in FIG. 11, stop bars 128*a* and 128*b* may also work in conjunction with peripheral portions of surfaces 132 of intermediate member 110, such as tabs 130*a* and 130*b*, to prevent over-rotation of either forefoot hinge member 104 or rear-foot hinge member 106 relative to intermediate member 110 when an articulated foldable sandal 10 including interdigitated hinge assembly 98 is moved to either the open or the folded position. Stop bar 128*a*, block segments 114, and spaces 116 may cooperatively form a plurality of apertures 134 in the insole face 136 of either forefoot hinge member 104 or rear-foot hinge member 106. As sandal 10 is moved to the folded position, the forefoot and rear-foot hinge members rotate relative to intermediate member 110 and the peripheral portion of extensions 126 until stop bar 128*a* contacts tabs 130*a* of surface 132, thereby limiting the rotation. Similarly, as sandal 10 is moved to the open position, the forefoot and rear-foot hinge members rotate relative to the intermediate member until stop bar 128*b* contacts tabs 130*b*. Interdigitated hinge assembly 98, as illustrated in FIGS. 8-11, includes all of these aforementioned rotational limitation elements. Articulated foldable sandals according to the present disclosure may include one or more of these rotation limiting elements. Additionally or alternatively, other rotation limiting elements may be provided or no rotation limiting elements may be provided. Each of these elements is optional, and may be included in any combination or subcombination.

With reference to FIG. 12, and continued reference to FIGS. 8-11, interdigitated hinge assembly 98 may also include elements that hold together forefoot hinge member 104, intermediate member 110, and rear-foot hinge member 106. At least one connecting member 138 may be positioned around posts 140 formed on body portions 112 of hinge members 104 and 106. Connecting member 138 may be a toroid of an elastic material that biases the hinge members toward each other, thereby sandwiching the intermediate member in between. In the illustrated embodiment, posts 140 are positioned on body portions 112 slightly skewed from the position of axles 48 and 50, toward both the insole face 136 of the hinge members and toward tongues 108. As a result, rotation of intermediate member 110 relative to either forefoot hinge member 104 or rear-foot hinge member 106 from the position corresponding to the open or the folded position of sandal 10 increases the distance between posts 140. Connecting member 138 may stretch, thereby increasing the amount of tension on the connecting member. Accordingly, connecting member 138 biases the interdigitated hinge assembly toward either the open position or the closed position.

In an alternate embodiment, connecting member 138 may be a toroid of an elastic material that is disposed in a groove around the perimeter (not shown) of interdigitated hinge assembly 98. In this alternate embodiment, connecting member 138 may bias interdigitated hinge assembly 98 toward either the open position or the folded position by means of offset positioning of the groove relative to axles 48 and 50 as well as by the relative distance between openings in the groove as the hinge assembly is moved between the open and folded positions.

While the various parts of interdigitated hinge assembly 98 are shown in FIGS. 8-12, it will be appreciated that variations are possible while maintaining features of the disclosed hinge assembly. For example, interdigitated hinge assembly 98 is shown with forefoot hinge member 104 and rear-foot hinge member 106 formed with symmetric dimensions on either side of intermediate member 110 such that the hinge members are interchangeable. As one exemplary variation, forefoot hinge member 104 and rear-foot hinge member 106 may be formed asymmetrically in some embodiments of an articulated foldable sandal according to the present disclosure. For example, the tongue 108 associated with forefoot hinge member 104 may be longer, shorter, wider, or otherwise shaped differently from the tongue associated with rear-foot hinge member 106.

In yet another exemplary variation within the scope of the present disclosure, the position of body portions 112 and extensions 126 may be reversed such that the body portions, including axles 48, 50, block segments 114, and spaces 116 are formed on intermediate member 110 and extensions 126 including passages 120, 122 are formed on hinge members 104 and 106. These or other variations may be applied to only one axis of interdigitated hinge assembly 98.

Forefoot hinge member 104, rear-foot hinge member 106, and intermediate member 110 may be fabricated from any suitable materials, including plastics, polymers, wood, or metal. These members may be formed by injection molding, machining, welding, or any suitable methods for forming parts from the suitable materials. Different members, or parts of the members, may be fabricated using different materials or using different methods.

While embodiments of articulated foldable sandals have been particularly shown and described, many variations may be made therein. This disclosure may include one or more independent or interdependent inventions directed to various combinations of features, functions, elements and/or properties, one or more of which may be defined in the following claims. Other combinations and sub-combinations of features, functions, elements and/or properties may be claimed later in this or a related application. Such variations, whether they are directed to different combinations or directed to the same combinations, whether different, broader, narrower or equal in scope, are also regarded as included within the subject matter of the present disclosure. An appreciation of the availability or significance of claims not presently claimed may not be presently realized. Accordingly, the foregoing embodiments are illustrative, and no single feature or element, or combination thereof, is essential to all possible combinations that may be claimed in this or a later application. Each claim defines an invention disclosed in the foregoing disclosure, but any one claim does not necessarily encompass all features or combinations that may be claimed. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

INDUSTRIAL APPLICABILITY

The methods and apparatus described in the present disclosure are applicable to articulated foldable sandals, and other industries in which footwear is used.

We claim:

1. An articulated foldable sandal, comprising:

a sole including a forward end and a rearward end opposite the forward end, the sole defining a line of articulation substantially midway between the forward end and the rearward end and including:

a forefoot portion that is adapted to be disposed under a front portion of a wearer's foot, the forefoot portion extending from the forward end to the line of articulation;

a rear-foot portion that is substantially similar in length to the length forefoot portion and that is adapted to be disposed under a rear portion of the wearer's foot, the rear-foot portion extending from the rearward end to the line of articulation; and an articulating member that is operatively coupled to both the forefoot portion and the rear-foot portion, wherein the articulating member includes at least two distinct axes of rotation and wherein the articulating member is adapted to enable the sandal to be selectively moved between an open configuration suitable for wearing and a folded configuration suitable for storage; and a retaining member fastened to the sole and adapted to hold the sandal on a wearer's foot.

2. The articulated foldable sandal of claim 1, wherein the forefoot portion and the rear-foot portion each includes:

an insole adapted to be disposed proximal the wearer's foot, the insole having an insole surface;

an outsole adapted to be disposed distal the wearer's foot, the outsole having an outsole surface; and a midsole portion disposed between the insole and the outsole; and wherein, the distance between the two distinct axes of rotation relative to the distance between the distinct axes of rotation and the ground when the sandal is placed flat on the ground in the open configuration causes the outsole surfaces of the forefoot portion and the rear-foot portion to be in flush contact or substantially adjacent when the sandal is moved into the folded configuration.

3. The articulated foldable sandal of claim 2, further comprising a biasing member that is that is operatively connected to the forefoot portion the rear-foot portion and that biases the forefoot portion and the rear-foot portion into the open configuration.

4. The articulated foldable sandal of claim 2, wherein the articulating member includes a first axis of rotation and a second axis of rotation, wherein the forefoot portion is adapted to rotate about the first axis and the rear-foot portion is adapted to rotate about the second axis, wherein the forefoot portion and the rear-foot portion are each adapted to rotate about 90 degrees when the sandal is moved from the open configuration to the folded configuration.

5. The articulated foldable sandal of claim 2, wherein the forefoot portion includes at least one forefoot cutout;

wherein the rear-foot portion includes at least one rear-foot cutout, wherein the forefoot cutout and the rear-foot cutout are adapted to be at least substantially contiguous when the sandal is placed in the open configuration to form an articulation aperture in the sole; and wherein the articulating member includes:

a block member that is adapted to be received in the articulation aperture;

a first axle that operatively couples the block member to the forefoot portion and that is adapted to allow the forefoot portion to rotate relative to the block member; and a second axle that operatively couples the block member to the rear-foot portion and that is adapted to allow the rear-foot portion to rotate relative to the block member.

6. The articulated foldable sandal of claim 5, wherein the forefoot portion includes at least one forefoot passage;

wherein the rear-foot portion includes at least one rear-foot passage;

wherein the block member includes a first and a second block passage;

wherein the forefoot passage and the first block passage are at least substantially aligned to cooperatively form a first passage that is adapted to receive the first axle; and wherein the rear-foot passage and the second block passage are at least substantially aligned to cooperatively form a second passage that is adapted to receive the second axle.

7. The articulated foldable sandal of claim 5, wherein the articulation aperture extends from the insole surface to the outsole surface.

8. The articulated foldable sandal of claim 7, wherein the sole further includes a medial edge and a lateral edge; and wherein the aperture is disposed interior to both the medial edge and the lateral edge.

9. The articulated foldable sandal of claim 7, wherein the rotation of the forefoot portion relative to the block member is independent of the rotation of the rear-foot portion relative to the block member.

10. The articulated foldable sandal of claim 2, wherein the forefoot portion includes at least one forefoot recess;

wherein the rear-foot portion includes at least one rear-foot recess;

wherein the forefoot recess and the rear foot recess are configured to be at least substantially aligned to form an articulation recess when the sandal is placed in the open configuration; and wherein the articulating member is disposed within the articulation recess.

11. The articulated foldable sandal of claim 10, wherein the articulation recess extends from the outsole surface part-way into the midsole.

12. The articulated foldable sandal of claim 1, wherein the first member includes a tubular member fixedly coupled to the forefoot portion and having a first passage through which the first axle passes;

wherein the second member includes a tubular member fixedly coupled to the rear-foot portion and having a second passage through which the second axle passes;

wherein the first axle, the second axle, and the third member cooperatively form a connecting member operatively coupled to the first member and to the second member.

13. The articulated foldable sandal of claim 12, wherein the connecting member includes a toroid that includes a first segment, a second segment, and two longitudinal segments, wherein the first segment provides the first axle, wherein the second segment provides the second axle, and wherein the two longitudinal segments cooperatively provide the third member.

14. The articulated foldable sandal of claim 1, wherein the axes of rotation are substantially parallel.

15. The articulated foldable sandal of claim 1, further including a bias member that is adapted to selectively bias the sandal into the open configuration or into the folded configuration.

16. The articulated foldable sandal of claim 1, wherein the forefoot portion includes a forward articulation end region;

wherein the rear-foot portion includes a rearward articulation end region; and wherein, when the sandal is placed in the open configuration, the forward articulation end region is configured to be adjacent to the rearward articulation end region.

17. The articulated foldable sandal of claim 1, wherein the sole further includes a longitudinal axis, and the line of articulation is substantially perpendicular to the longitudinal axis.

18. The articulated foldable sandal of claim 1, wherein at least one of the forefoot portion and the rear-foot portion is adapted to prevent at least one of the forefoot portion and the rear-foot portion from rotating beyond a predetermined orientation in the open position.

19. The articulated foldable sandal of claim 1, wherein the rotation of the forefoot portion relative to the articulating member is independent of the rotation of the rear-foot portion relative to the articulating member.

20. An articulated foldable sandal, comprising:

a sole including:

a forefoot portion that is adapted to be disposed under a front portion of a wearer's foot;

a rear-foot portion that is adapted to be disposed under a rear portion of the wearer's foot;

an articulating member that is operatively coupled to both the forefoot portion and the rear-foot portion, wherein the articulating member includes at least two distinct and substantially parallel axes of rotation and wherein the articulating member is adapted to enable the sandal to be selectively moved between an open configuration suitable for wearing and a folded configuration; and a retaining member fastened to the sole and adapted to hold the sandal on a wearer's foot;

wherein the forefoot portion and the rear-foot portion each includes:

an insole having an insole surface adapted to be disposed proximal the wearer's foot;

an outsole having an outsole surface adapted to be disposed distal the wearer's foot; and and a midsole portion disposed between the insole and the outsole;

wherein, when the sandal is moved into the folded configuration, the outsole surfaces of the forefoot portion and the rear-foot portion are disposed adjacent each other; and wherein the articulating member includes a first axis of rotation and a second axis of rotation, wherein the forefoot portion is adapted to rotate about the first axis and the rear-foot portion is adapted to rotate about the second axis, wherein the forefoot portion and the rear-foot portion are each adapted to rotate about 90 degrees downward when the sandal is moved from the open configuration to the folded configuration and are restricted from rotating upward when the sandal is in the open configuration.

21. An articulated foldable sandal, comprising:

a sole including:

a forefoot portion that is adapted to be disposed under a front portion of a wearer's foot, the forefoot portion including a forward articulation end region;

a rear-foot portion that is adapted to be disposed under a rear portion of the wearer's foot, the rear-foot portion includes a rearward articulation end region; and an articulating member that is operatively coupled to both the forefoot portion and the rear-foot portion, wherein the articulating member includes at least two distinct axes of rotation and wherein the articulating member is adapted to enable the sandal to be selectively moved between an open configuration suitable for wearing and a folded configuration; and a retaining member fastened to the sole and adapted to hold the sandal on a wearer's foot;

wherein the forefoot portion and the rear-foot portion each includes:

an insole having an insole surface adapted to be disposed proximal the wearer's foot;

an outsole having an outsole surface adapted to be disposed distal the wearers foot, the outsole having an outsole surface; and a midsole portion disposed between the insole and the outsole;

wherein, when the sandal is moved into the folded configuration, a substantial portion of the outsole surfaces of the forefoot portion and the rear-foot portion are in flush contact with each other;

wherein the articulating member includes a first axis of rotation and a second axis of rotation, wherein the forefoot portion is adapted to rotate about the first axis and the rear-foot portion is adapted to rotate about the second axis, wherein the forefoot portion and the rear-foot portion are each adapted to rotate about 90 degrees when the sandal is moved from the open configuration to the folded configuration; and wherein, when the sandal is placed in the open configuration, the forward articulation end region is configured to be adjacent to the rearward articulation end region.

22. An articulated foldable sandal, comprising:

a sole including:

a forefoot portion including at least one forefoot recess and that is adapted to be disposed under a front portion of a wearer's foot;

a rear-foot portion including at least one rear-foot recess and that is adapted to be disposed under a rear portion of the wearer's foot; and an articulating member that is operatively coupled to both the forefoot portion and the rear-foot portion, the articulating member being adapted to enable the sandal to be selectively moved between an open configuration suitable for wearing and a folded configuration, the forefoot recess and the rear foot recess being configured to be at least substantially aligned to form an articulation recess when the sandal is placed in the open configuration and the articulating member being disposed within the articulation recess, the articulating member including:

at least two distinct axes of rotation, a first member that is operatively coupled to the forefoot portion;

a second member that is operatively coupled to the rear-foot portion;

a third member that is adapted to move independently of both the first member and the second member;

a first axle that operatively couples the first member to the third member and that is adapted to allow the first member to rotate relative to the third member; and a second axle that operatively couples the second member to the third member and that is adapted to allow the second member to rotate relative to the third member; and a retaining member fastened to the sole and adapted to hold the sandal on a wearer's foot;

wherein the forefoot portion and the rear-foot portion each includes: an insole adapted to be disposed proximal the wearer's foot, the insole having an insole surface; an outsole adapted to be disposed distal the wearer's foot, the outsole having an outsole surface; and a midsole portion disposed between the insole and the outsole; and wherein, when the sandal is moved into the folded configuration, either the outsole surfaces or the insole surfaces of the forefoot portion and the rear-foot portion are disposed adjacent each other.

23. The articulated foldable sandal of claim 22, wherein:

the forefoot recess further includes a forefoot cavity that extends forward through the midsole;

the rear-foot recess further includes a rear-foot cavity that extends rearward through the midsole;

the articulating member includes:

a forefoot member including the first member and the first axle and having a forefoot tongue that is adapted to be inserted into the forefoot cavity; and a rear-foot member including the second member and the second axle and having a rear-foot tongue that is adapted to be inserted into the rear foot cavity;

the third member is disposed between the forefoot member and the rear-foot member, and includes:

a first passage through which the first axle passes; and a second passage through which the second axle passes; and the articulation member further includes at least one fourth member that is adapted to hold together the forefoot member, the rear-foot member, and the third member.

24. The articulated foldable sandal of claim 23, wherein:

the third member includes at least one surface; and one or both of the forefoot member and the rear foot member includes at least one stop bar that is adapted to contact one or more of the surfaces of the third member to prevent rotation of the forefoot member or the rear foot member relative to the third member of more than substantially 90 degrees when the sandal is moved to the folded configuration.

25. The articulated foldable sandal of claim 23, wherein:

the third member includes at least one surface; and one or both of the forefoot member and the rear foot member includes at least one stop bar that is adapted to contact one or more of the surfaces of the third member to prevent rotation of the forefoot member or the rear-foot member relative to the third member beyond a predetermined orientation when the sandal is moved to the open configuration.

26. The articulated foldable sandal of claim 22, wherein movement of the first member relative to the third member is independent of movement of the second member relative to the third member.

27. A folding sandal comprising:

an articulating member defining a first rotation axis at a forward articulation end of the articulating member and a second rotation axis at a rearward articulation end opposite the forward articulation end;

a forefoot sole member having a forefoot outsole surface for contacting the ground when the folding sandal is worn and a forefoot insole surface for contacting a user's foot when the folding sandal is worn and that is spaced from the forefoot outsole surface, the forefoot sole member being pivotally connected to the forward articulation end of the articulating member at a position proximate the forefoot outsole surface and distal the forefoot insole surface; and a rear-foot sole member having a rear-foot outsole surface for contacting the ground when the folding sandal is worn and a rear-foot insole surface for contacting a user's foot when the folding sandal is worn and that is spaced from the rear-foot outsole surface, the forefoot sole member being pivotally connected to the rearward articulation end of the articulating member at a position proximate the rear-foot outsole surface and distal the rear-foot insole surface, wherein forefoot sole member and the rear-foot member are substantially the same length.

28. The folding sandal of claim 27, wherein the articulating member includes a biasing member that is operatively connected to the forefoot sole member and the rear-foot sole member and that biases the forefoot sole member and the rear-foot sole member into an open position where the forefoot sole member and the rear-foot sole member are inline with each other and the folding sandal is suitable for wearing.

29. The folding sandal of claim 27, wherein the forefoot sole member is pivotally connected to the first articulation axis of the articulating member at a position proximate a longitudinal end of the forefoot sole member.

30. The articulated foldable sandal of claim 1, wherein the forefoot portion and the rear-foot portion support the user's foot from the ground substantially without contributing support from the articulating member.

* * * * *